US009039798B2

(12) United States Patent
Lai Sang et al.

(10) Patent No.: US 9,039,798 B2
(45) Date of Patent: May 26, 2015

(54) SUPER-HARD CONSTRUCTION AND METHOD FOR MAKING SAME

(75) Inventors: Lai Hong Lai Sang, Springs (ZA); Nedret Can, Didcot (GB); Tleyane Jonas Sono, Springs (ZA)

(73) Assignee: ELEMENT SIX ABRASIVES S.A., Luxembourg (LU)

( * ) Notice: Subject to any disclaimer, the term of this patent is extended or adjusted under 35 U.S.C. 154(b) by 0 days.

(21) Appl. No.: 14/235,792

(22) PCT Filed: Aug. 1, 2012

(86) PCT No.: PCT/EP2012/065084

§ 371 (c)(1),
(2), (4) Date: Jan. 28, 2014

(87) PCT Pub. No.: WO2013/017642

PCT Pub. Date: Feb. 7, 2013

(65) Prior Publication Data

US 2014/0223834 A1 Aug. 14, 2014

Related U.S. Application Data

(60) Provisional application No. 61/514,758, filed on Aug. 3, 2011.

(30) Foreign Application Priority Data

Aug. 3, 2011 (GB) ..... 1113391.5

(51) Int. Cl.
*B24D 3/02* (2006.01)
*C09C 1/68* (2006.01)
(Continued)

(52) U.S. Cl.
CPC . *B22F 3/14* (2013.01); *B22F 7/062* (2013.01); *E21B 10/567* (2013.01); *B22F 2998/00* (2013.01); *C22C 2204/00* (2013.01); *B22F 7/06* (2013.01)

(58) Field of Classification Search
None
See application file for complete search history.

(56) References Cited

U.S. PATENT DOCUMENTS 7,396,501 B2 * 7/2008 Pope et al. ..... 264/642
7,543,662 B2 * 6/2009 Belnap et al. ..... 175/426
(Continued)

FOREIGN PATENT DOCUMENTS

GB 2384260 A 7/2003
GB 2456224 A 7/2009
(Continued)

OTHER PUBLICATIONS

United Kingdom Patent Application No. 1113391.5, Combined Search and Examination Report mailed Nov. 29, 2011, 6 pages.
(Continued)

*Primary Examiner* — Kaj K Olsen
*Assistant Examiner* — Ross J Christie
(74) *Attorney, Agent, or Firm* — Dean W. Russell; Clark F. Weight; Kilpatrick Townsend & Stockton LLP

(57) ABSTRACT

A method for making a super-hard construction comprising a first structure comprising a first material joined to a second structure comprising a second material, in which the coefficient of thermal expansion (CTE) and Young's moduli of the materials of each material are substantially different from each other. The method includes forming an assembly comprising the first material, the second material and a binder material arranged to be capable of bonding the first and second materials together, the binder material comprising metal; subjecting the assembly to a sufficiently high temperature for the binder material to be in the liquid state and to a first pressure at which the super-hard material is thermodynamically stable; reducing the pressure to a second pressure at which the super-hard material is thermodynamically stable, the temperature being maintained sufficiently high to maintain the binder material in the liquid state; reducing the temperature to solidify the binder material; and reducing the pressure and the temperature to an ambient condition to provide the super-hard construction.

26 Claims, 4 Drawing Sheets

Figure 1:
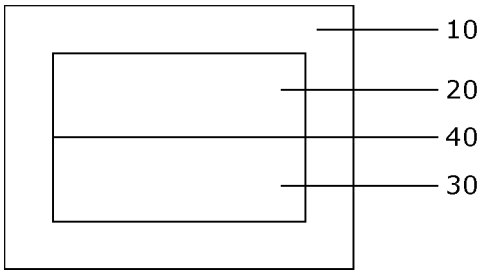

(51) Int. Cl.

| | |
|---|---|
| ***C09K 3/14*** | (2006.01) |
| ***B22F 3/14*** | (2006.01) |
| ***B22F 7/06*** | (2006.01) |
| ***E21B 10/567*** | (2006.01) |

(56) References Cited

U.S. PATENT DOCUMENTS

| | | | | |
|---|---|---|---|---|
| 7,569,176 | B2 * | 8/2009 | Pope et al. | 264/604 |
| 7,678,325 | B2 * | 3/2010 | Gardinier | 264/604 |
| 2005/0133277 | A1 * | 6/2005 | Dixon | 175/426 |
| 2005/0146086 | A1 * | 7/2005 | Pope et al. | 264/602 |
| 2006/0263233 | A1 * | 11/2006 | Gardinier | 419/11 |
| 2007/0079994 | A1 * | 4/2007 | Middlemiss | 175/426 |
| 2008/0154380 | A1 * | 6/2008 | Dixon et al. | 623/17.16 |
| 2009/0046967 | A1 * | 2/2009 | Pope et al. | 384/492 |
| 2009/0090563 | A1 | 4/2009 | Voronin et al. | |
| 2010/0018127 | A1 * | 1/2010 | Can et al. | 51/309 |
| 2010/0025898 | A1 * | 2/2010 | Pope et al. | 264/669 |
| 2010/0084196 | A1 * | 4/2010 | Bertagnolli et al. | 51/297 |
| 2010/0196717 | A1 * | 8/2010 | Liversage et al. | 428/408 |
| 2010/0198353 | A1 * | 8/2010 | Pope et al. | 623/17.11 |
| 2010/0239483 | A1 * | 9/2010 | Middlemiss | 423/345 |
| 2010/0300764 | A1 | 12/2010 | Naidoo et al. | |
| 2010/0320006 | A1 * | 12/2010 | Fan et al. | 51/296 |
| 2011/0024201 | A1 | 2/2011 | Scott et al. | |
| 2011/0067929 | A1 * | 3/2011 | Mukhopadhyay et al. | 51/307 |
| 2011/0083908 | A1 * | 4/2011 | Shen et al. | 51/307 |
| 2011/0132667 | A1 * | 6/2011 | Smallman et al. | 51/307 |
| 2011/0176879 | A1 * | 7/2011 | Jonker et al. | 408/144 |
| 2011/0220415 | A1 * | 9/2011 | Jin et al. | 175/57 |
| 2011/0283628 | A1 * | 11/2011 | Saridikmen et al. | 51/307 |
| 2014/0165476 | A1 * | 6/2014 | Can et al. | 51/309 |

FOREIGN PATENT DOCUMENTS

| | | | |
|---|---|---|---|
| WO | 2007019581 | A2 | 2/2007 |
| WO | 2009147629 | A1 | 12/2009 |
| WO | 2010140108 | A1 | 12/2010 |

OTHER PUBLICATIONS

United Kingdom Patent Application No. 1213707.1, Search Report mailed Oct. 2, 2012, 4 pages.

International Patent Application No. PCT/EP2012/065084, International Search Report and Written Opinion mailed Nov. 12, 2012, 14 pages.

* cited by examiner

SUPER-HARD CONSTRUCTION AND METHOD FOR MAKING SAME

CROSS REFERENCE TO RELATED APPLICATIONS

This application is the U.S. national phase of International Application No. PCT/EP2012/065084 filed on Aug. 1, 2012, and published in English on Feb. 7, 2013as International Publication No. WO 2013/017642 A1, which application claims priority to Great Britain Patent Application No. 1113391.5 filed on Aug. 3, 2011 and U.S. Provisional Application No. 61/514,758 filed on Aug. 3, 2011, the contents of all of which are incorporated herein by reference.

The disclosure relates generally to a method for making super-hard constructions and to constructions thus made.

United States patent application publication number 2010/0300764 discloses a method of making PCD material, the method including subjecting an aggregated mass of diamond grains to a pressure treatment at a pressure of greater than 6.0 gigapascals in the presence of a metallic catalyst material for diamond at a temperature sufficiently high for the catalyst material to melt, and sintering the diamond grains to form PCD material.

There is a need for super-hard constructions having reduced incidence of cracking.

Viewed from a first aspect, there can be provided a method for making a super-hard construction comprising a first structure joined to a second structure, the first structure comprising first material having a first coefficient of thermal expansion (CTE) and a first Young's modulus, and the second structure comprising second material having a second CTE and a second Young's modulus; the first CTE and the second CTE being substantially different from each other and the first and second Young's moduli being substantially different from each other; at least one of the first or second materials comprising super-hard material; the method including forming an assembly comprising the first material, the second material and a binder material arranged to be capable of bonding the first and second materials together, the binder material comprising metal; subjecting the assembly to a sufficiently high temperature for the binder material to be in the liquid state and to a first pressure at which the super-hard material is thermodynamically stable; reducing the pressure to a second pressure at which the super-hard material is thermodynamically stable, the temperature being maintained sufficiently high to maintain the binder material in the liquid state; reducing the temperature to solidify the binder material; and reducing the pressure and the temperature to an ambient condition to provide the super-hard construction.

Various arrangements and combinations are envisaged for the method and the super-hard construction by the disclosure, and examples of the method may include one or more of the following non-exhaustive and non-limiting aspects in various combinations.

The CTE of one of the first or second materials may be at least about $2.5\times10^{-6}$ per degree Celsius (2.5 times ten raised to the power of minus six, per degree Celsius) or at least about $3.0\times10^{-6}$ per degree Celsius (3.0 times ten raised to the power of minus six, per degree Celsius) and at most about $5.0\times10^{-6}$ per degree Celsius (5.0 times ten raised to the power of minus six, per degree Celsius) or at most about $4.5\times10^{-6}$ per degree Celsius (4.5 times ten raised to the power of minus six, per degree Celsius), and the CTE of the other of the first or second materials may be at least about $3.5\times10^{-6}$ per degree Celsius (3.5 times ten raised to the power of minus six, per degree Celsius) or at least about $4.5\times10^{-6}$ per degree Celsius (4.5 times ten raised to the power of minus six, per degree Celsius) and at most about $6.5\times10^{-6}$ per degree Celsius (6.5 times ten raised to the power of minus six, per degree Celsius) or at most about $6.0\times10^{-6}$ per degree Celsius (6.0 times ten raised to the power of minus six, per degree Celsius), measured at about 25 degrees Celsius. The CTE of the first and second materials may differ by at least about 10%, at least about 20% or at least about 30%.

The Young's modulus of one of the first or second materials may be at least about 500 gigapascals and at most about 1,300 gigapascals or at most about 1,000 gigapascals and the Young's modulus of the other of the first and second materials may be at least about 800 gigapascals and at most about 1,600 gigapascals or at most about 1,300 gigapascals. The Young's moduli of the first and second materials may differ by at least about 10%, at least about 20% or at least about 30%.

The second material may comprise diamond grains, cBN grains, PCD material and or PCBN material. At least one of the first or second materials may comprise metal. The binder material may comprise catalyst material for promoting the formation of at least one of the first or second materials. The binder material may be catalyst or matrix material for sintering PCD or PCBN, such as Co, Fe, Ni or Mn. The first and or second material may include the binder material, or a third structure may provide a source of the binder material.

The method may include sintering an aggregation of a plurality of grains of super-hard material in the presence of catalyst material at a sinter pressure and a sinter temperature to form the second structure. The first pressure may be substantially the sinter pressure.

The method may include disposing an aggregation of grains of super-hard material adjacent the first structure and in the presence of the binder material to form a pre-sinter assembly; subjecting the pre-sinter assembly to a sinter pressure and a sinter temperature to melt the binder material and sinter the grains of super-hard materials and form a second structure comprising polycrystalline super-hard material connected to the first structure by the binder material in the molten state. The first pressure may be substantially the sinter pressure.

The method may include providing a first structure, a second structure comprising polycrystalline super-hard material, disposing the first structure proximate the second structure and forming a pre-construction assembly, applying a pressure to the pre-construction assembly, increasing the pressure from ambient pressure to the first pressure. The method may include subjecting an aggregation of a plurality of grains of super-hard material to a sinter pressure and a sinter temperature at which the super-hard material is capable of being sintered, and reducing the pressure and temperature to an ambient condition to provide the second structure; the first pressure being substantially greater then the sinter pressure.

The difference between the second pressure and the first pressure may be at least about 0.5 gigapascals. For example, the first pressure may be at least 6 gigapascals and the second pressure may be at least about 5.5 gigapascals, or the first pressure may be at least about 7.5 gigapascals or at least about 8 gigapascals and the second pressure may be at most 7 gigapascals.

The pressure at which the binder material begins to solidify may be substantially equal to the second pressure or it may be less than the second pressure. In other words, the pressure at which the binder material is caused to begin to solidify responsive to the temperature being reduced may be substantially equal to the second pressure. The pressure within the pre-sinter assembly during the process of solidification may vary from the second pressure.

In some examples, the second pressure may be substantially closer to a phase boundary between super-hard and softer allotropes or phases of the super-hard material, such as diamond or cubic boron nitride (CBN), than is the first pressure, provided that the second pressure is sufficiently high for the super-hard allotrope or phase to be more thermodynamically stable than the softer allotrope or phase, such as graphite or hexagonal boron nitride. In some examples, the second pressure may be at most about 2 gigapascals, at most about 1.5 gigapascals or at most about 1 gigapascal higher than the pressure on the phase boundary between the super-hard and softer allotrope or phase. In some examples, the second pressure may be at least about 0.2 gigapascals higher than the pressure on the phase boundary between the super-hard and softer allotrope or phase.

The method may include an intermediate step of reducing the pressure from the first pressure to an intermediate pressure for a holding period, and then further reducing the pressure from the intermediate pressure to the second pressure. In some examples, the first pressure may be at least about 10 gigapascals and the method may include reducing the pressure to an intermediate pressure of at least about 7 gigapascals and less than 10 gigapascals for a holding period, and then further reducing the pressure to the second pressure, in which the second pressure is at least about 5.5 gigapascals and at most about 7 gigapascals. The holding period may be at least about 30 seconds or at least about 1 minute. The inclusion of the intermediate step may contribute to reducing the likelihood of cracking of the super-hard construction, particularly but not exclusively in examples where the first pressure is at least about 10 gigapascals. The holding period may be sufficiently long for pressure and temperature substantially to equilibrate (at least as far as practically possible) throughout the first and second structures.

The method may include subjecting the super-hard construction to further heat treatment for a treatment period at a treatment temperature and a treatment pressure at which the super-hard material is thermodynamically unstable or metastable. The treatment temperature may be at least about 500 degrees Celsius and or at most about 800 degrees Celsius and the treatment pressure may be less than 1 gigapascal or substantially a vacuum. The treatment period may be at least 5 minutes, at least 15 minutes or at least 30 minutes.

In some examples, the first structure may comprise or consist essentially of cobalt-cemented tungsten carbide material (in which the binder material comprises cobalt substantially in elemental, metallic form) and the second material may comprise or consist essentially of PCD material. In some examples, the super-hard construction may have the general shape of a solid cylinder, each of the structures being generally disc-like in shape and joined to each other at respective major end surfaces. The super-hard construction may be configured to be suitable for use as a cutter insert for a drill bit for boring into the earth. In some examples, the PCD structure may have a mean thickness (between major end surfaces) of at least about 1 millimeter or at least about 2 millimeters and at most about 4 millimeters or at most about 3 millimeters. The CTE of the cemented carbide material may be at least about $4.5\times10^{-6}$ (4.5 times ten raised to the power of minus six) per degree Celsius and at most about $6.5\times10^{-6}$ (6.5 times ten raised to the power of minus six) per degree Celsius, and the CTE of the PCD material may be at least about $3.0\times10^{-6}$ (3.0 times ten raised to the power of minus six) per degree Celsius and at most about $5.0\times10^{-6}$ (5.0 times ten raised to the power of minus six) per degree Celsius, the CTE of the cemented carbide material and the PCD material differing by at least about 10% (the CTE being measured at about 25 degrees centigrade); the Young's modulus of the cemented carbide material being at least about 500 gigapascals and at most about 1,000 gigapascals, and the Young's modulus of the PCD material being at least about 800 gigapascals and at most about 1,600 gigapascals, the Young's moduli of the cemented carbide material and the PCD material differing by at least about 10%. The first pressure may be at least about 6 gigapascals, at least about 7 gigapascals or at least about 7.5 gigapascals, and the second pressure may be at least about 5.5 gigapascals, at least about 6.0 gigapascals or at least about 6.5 gigapascals and at most about 8 gigapascals, at most about 7.5 gigapascals or at most about 7 gigapascals. In some examples, the first pressure may be at most about 10 gigapascals. The pressure at which the cobalt-based binder material begins to solidify (just prior to solidification) may be substantially the second pressure. In a particular example, the second pressure may be in the range of about 6.5 to about 7.5 gigapascals. An example method may include subjecting the super-hard construction comprising the PCD structure to further heat treatment for a treatment period at a treatment temperature and a treatment pressure at which the super-hard material is thermodynamically unstable or meta-stable. For example, the treatment temperature may be at least about 550 degrees Celsius and at most about 650 degrees Celsius, the treatment pressure may be less than 0.5 gigapascal or substantially a vacuum, and the treatment period may be at least about 30 minutes and at most about 90 minutes.

The method may include processing the super-hard construction to provide a tool element. The super-hard construction may be suitable for an insert for a rock-boring drill bit, for an impact tool for degrading rock or pavement or for a machine tool.

Disclosed methods have the aspect of reducing the likelihood or frequency of cracking of super-hard constructions, particularly when subjected to heating in subsequent manufacturing steps or to elevated temperatures in use.

Figure 2:
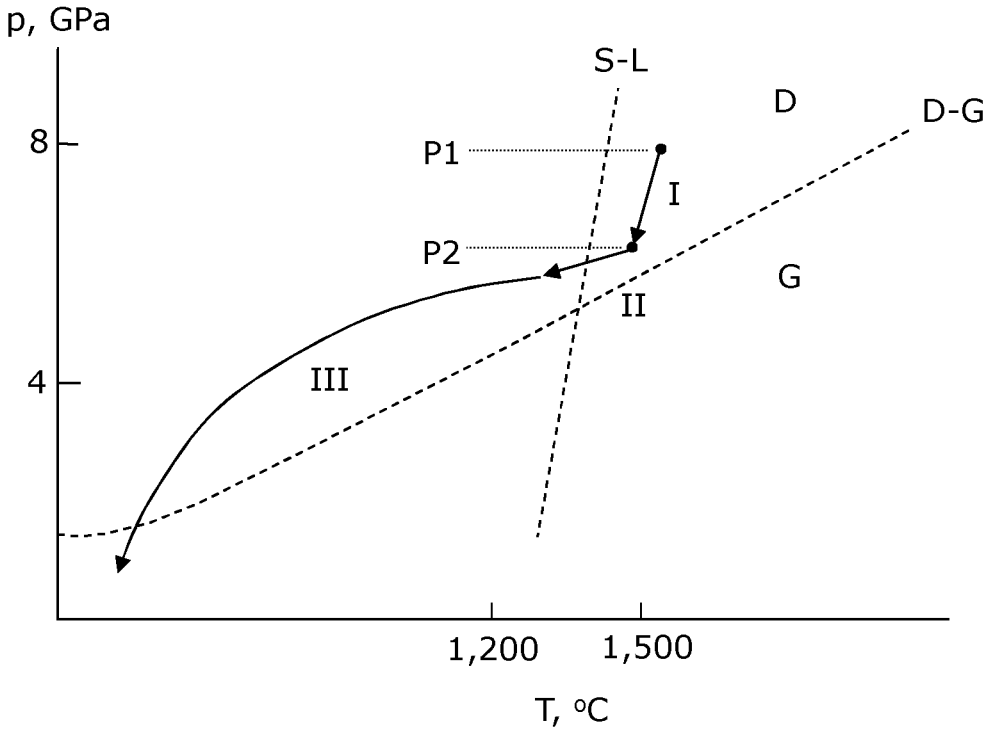

Example arrangements will be described with reference to the accompanying drawings, of which FIG. 1 shows a schematic side view of an example assembly comprising first and second structures;

FIG. 2 shows a schematic diagram of part of an example pressure and temperature cycle for making a super-hard construction; and FIG. 3 to FIG. 7 show schematic diagrams of parts of example pressure and temperature cycles for making a PCD construction.

With reference to FIG. 1, a PCD structure (the second structure) 20 is disposed adjacent a cemented carbide substrate (the first structure) 30, a thin layer or film 40 of binder material comprising Co connecting opposite major surfaces of the PCD structure 20 and the substrate 30 to comprise an assembly encased in a housing 10 for an ultra-high pressure, high temperature press (not shown). The CTE of the PCD material comprised in the PCD structure 20 is in the range from about $2.5\times10^{-6}$ per degree Celsius to about $4\times10^{-6}$ per degree Celsius and the CTE of the cobalt-cemented tungsten carbide material comprised in the substrate 30 is in the range from about $5.4\times10^{-6}$ per degree Celsius to about $6\times10^{-6}$ per degree Celsius (the CTE values are for 25 degrees Celsius). In this example, the substrate 30 and the PCD structure 20 contain binder material comprising Co. It is estimated that PCD material would have a Young's modulus from about 900 gigapascals to about 1,400 gigapascals depending on the grade of PCD and that the substrate would have a Young's modulus from about 500 gigapascals to about 650 gigapascals depending largely on the content and composition of the binder material.

FIG. 2 shows a schematic phase diagram of carbon in terms of pressure p and temperature T axes, showing the line D-G of thermodynamic equilibrium between diamond and graphite allotropes, diamond being the more thermally stable in region D and graphite being the more thermally stable in region G of the diagram. The line S-L shows schematically the temperature at which the binder material melts or solidifies at various pressures, this temperature tending to increase with increasing pressure. Note that this temperature is likely to be different from that for the binder material in a pure form because the presence of carbon from the diamond and or some dissolved WC is expected to reduce this temperature, since the presence of carbon in solution is expected to reduce the melting point of cobalt and other metals. The assembly described with reference to FIG. 1 may be under a first pressure P1 of about 7.5 gigapascals to about 8 gigapascal and at a temperature of about 1,450 degrees Celsius to about 1,800 degrees Celsius, at a condition at which the PCD material has been formed by sintering an aggregation of diamond grains disposed adjacent the substrate. There may be no substantial interruption between the formation of the PCD in situ at the sinter pressure and sinter temperature on the one hand and subjecting the assembly to the first pressure P1 on the other; it is the subsequent relationship between the reduction of the pressure and the temperature at stages I and II that is the more relevant aspect of the method. At the sinter temperature, the Co binder material will be molten and expected to promote the direct inter-growth sintering of the diamond grains to form the PCD material, the diamond comprised in the PCD material being thermodynamically substantially more stable than graphite at the sinter temperature and sinter pressure.

With further reference to FIG. 2, the pressure and temperature of the assembly may be reduced to ambient levels in stages I, II and III. In a particular example, the pressure may be reduced in stage I from the first pressure P1 to a second pressure P2 of about 5.5 gigapascals to about 6 gigapascals while reducing the temperature to about 1,350 degrees Celsius to about 1,500 degrees Celsius to ensure that the pressure-temperature condition remains such that diamond is more thermodynamically stable than graphite and that the binder material remains substantially molten. In stage II, the temperature may then be reduced to about 1,100 degrees Celsius to a temperature in the range of about 1,200 degrees Celsius while maintaining the pressure above the line D-G in the diamond-stable region D to solidify the binder material; and in stage III the pressure and temperature may be reduced to ambient levels in various ways. The PCD construction can then be removed from the press apparatus. Note that the stages I, II and III are used merely to explain FIG. 2 and there may not be clear distinction between these stages in practice. For example these stages may flow smoothly into one another with no substantial period of maintaining pressure and temperature conditions at the end of a stage. Alternatively, some or all of the stages may be distinct and the pressure and temperature condition at the end of a stage may be maintained for a period.

In some examples, a pre-sinter assembly for making a PCD or PCBN construction, for example, may be prepared and provided in situ at the first pressure P1 as follows. A cup may be provided into which an aggregation comprising a plurality of diamond or CBN grains and a substrate may be assembled, the interior shape of the cup being generally that of the desired shape of the PCD or PCBN structure (having regard to likely distortion during the sintering step). The aggregation may comprise substantially loose diamond or CBN grains or diamond- or CBN-containing pre-cursor structures such as granules, discs, wafers or sheets. The aggregation may also include catalyst material for diamond, matrix material for PCBN, or pre-cursor material for catalyst or matrix material, which may be admixed with the diamond or CBN grains and or deposited on the surfaces of the diamond or CBN grains. The diamond or CBN grains may have a mean size of at least about 0.1 micron and or at most about 75 microns and may be substantially mono-modal or multi-modal. The aggregation may also contain additives for reducing abnormal diamond or CBN grain growth or the aggregation may be substantially free of catalyst material or additives. Alternatively or additionally, another source of catalyst or matrix material such as cobalt may be provided, such as the binder material in a cemented carbide substrate. A sufficient quantity of the aggregation may be placed into the cup and then the substrate may inserted into the cup with a proximate end pushed against the aggregation. The pre-sinter assembly comprising the aggregation and the substrate may be encased within a metal jacket comprising the cup, subjected to a heat treatment to burn off organic binder that may be comprised in the aggregation, and encapsulated within a housing (which may be referred to as a capsule) suitable for an ultra-high pressure press. The housing may be placed in a suitable ultra-high pressure press apparatus and subjected to a sinter pressure and sinter temperature to form the assembly comprising a PCD or PCBN structure adjacent the substrate, connected by a thin film of molten binder comprising cobalt. In examples such as these, the sinter pressure may be regarded as the first pressure P1.

In an example arrangement, a pre-sinter assembly for making a PCD or PCBN construction may be prepared and provided in a press apparatus at the first pressure P1 as follows. A PCD or PCBN structure may be provided pre-sintered in a previous ultra-high pressure, high temperature process. The PCD or PCBN structure may contain binder or matrix material comprising cobalt, located in interstitial regions between the diamond or CBN grains comprised in the PCD or PCBN material. In the case of PCD material, the PCD structure may have at least a region substantially free of binder material. For example, the PCD structure may have been treated in acid to remove binder material from the interstices at least adjacent a surface of the PCD structure or throughout substantially the entire volume of the PCD structure (or variations between these possibilities), leaving at least a region that may contain pores or voids. In some examples, voids thus created may be filled with a filler material that may or may not comprise binder material. The PCD or PCBN structure may be placed against a substrate and the resulting pre-construction assembly may be encased within a housing suitable for an ultra-high pressure press. The housing may be placed in a suitable ultra-high pressure press apparatus and the subjected to the first pressure P1 at a temperature at which the binder material is in the liquid state (at a condition in region D of FIG. 2).

Example methods for making an example PCD construction will be described below with reference to FIG. 3 to FIG. 7. In each figure, only part of the pressure and temperature cycle is shown, the part beginning at respective first pressures P1, at which the PCD material comprised in the construction becomes formed by sintering, and ending after the temperature has been reduced sufficiently to solidify the binder material and the pressure has been reduced from the second pressure P2.

In some examples, a pre-sinter assembly may be provided, comprising an aggregation of a plurality of diamond grains located adjacent a surface of a substrate comprising cobalt-cemented tungsten carbide. The diamond grains may have a mean size in the range of about 0.1 to about 40 microns. The pre-sinter assembly may be encapsulated within a capsule for an ultra-high pressure press apparatus, into which the capsule may be loaded. The capsule may be pressurised at ambient temperature to a pressure of at least about 6.5 gigapascals and heated to a temperature in the range of about 1,500 to about 1,600 degrees Celsius, substantially greater than the melting point (at the pressure) of the cobalt-based binder material comprised in the substrate and causing the cobalt material to melt. At this temperature the pre-sinter assembly may be at a first pressure P1 in the range from about 7.5 to about 10 gigapascals (P1 may be somewhat higher than 7 gigapascals at least partly as a result of the increase in temperature). The first pressure P1 and the temperature may be substantially maintained for at least about 1 minute, or in any event sufficiently long to sinter together the diamond grains (in these examples, the sinter pressure will be substantially P1). The pressure may then be reduced from first pressure P1 through a second pressure P2 in the range from about 5.5 to about 8.5 gigapascals. The second pressure may be the pressure at which the binder material begins to solidify as the temperature is reduced through its solidification temperature.

The temperature of the pre-sinter assembly may be reduced simultaneously with pressure, provided that it remains greater than the temperature at which the cobalt-based binder material will have completely solidified. As the pressure is reduced from P2, the temperature may also be reduced through the solidification line of the cobalt-based binder material, resulting in the solidification of the binder material. In these particular examples, the pressure is substantially continuously reduced from the first pressure P1, through the second pressure P2 and through the pressure(s) at which the binder material solidifies, without substantial pause. The rate of reduction of the pressure and or temperature may be varied or the rate of the reduction of either or both may be substantially constant, at least until the cobalt-based binder material has solidified. The temperature may also be reduced substantially continuously at least until it is sufficiently low for substantially all the cobalt-based binder material to have solidified. The temperature and pressure may then be reduced to ambient conditions, the capsule removed from the ultra-high pressure press apparatus and the construction removed from the capsule. The construction may comprise a sintered PCD structure formed joined to the substrate, the PCD structure having become joined to the substrate in the same general step in which the PCD material was formed by the sintering together of the plurality of diamond grains. A thin layer rich in cobalt will be present between the PCD structure and the substrate, joining together these structures.

Figure 3:
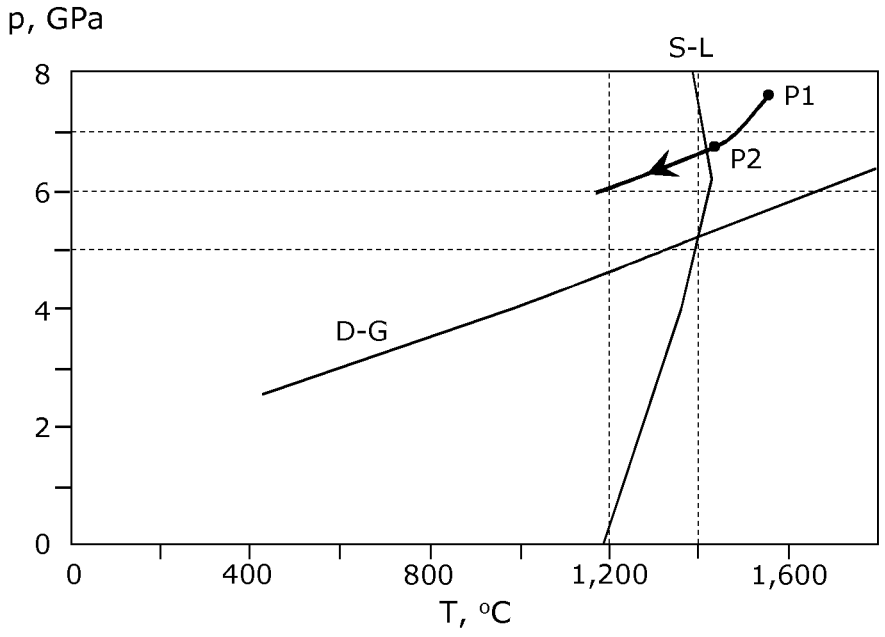

In a particular example method illustrated in FIG. 3, the first pressure P1 is about 7.6 gigapascals, the temperature at the first pressure being in the range of about 1,500 to about 1,600 degrees Celsius, and an example second pressure P2 is about 6.8 gigapascals.

Figure 4:
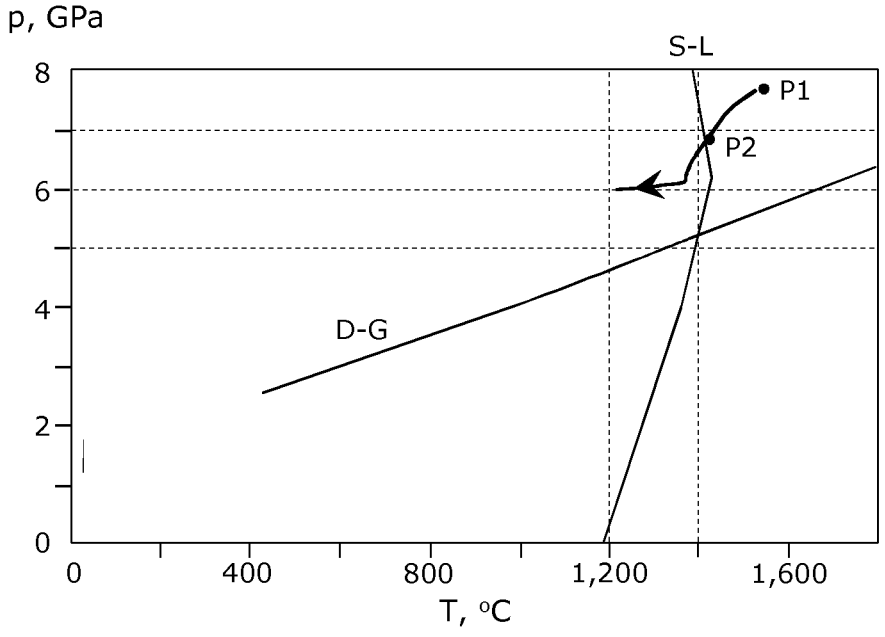

In a particular example method illustrated in FIG. 4, the first pressure P1 is about 7.7 gigapascals, the temperature at the first pressure being in the range of about 1,500 to about 1,600 degrees Celsius, and an example second pressure P2 is about 6.9 gigapascals.

Figure 5:
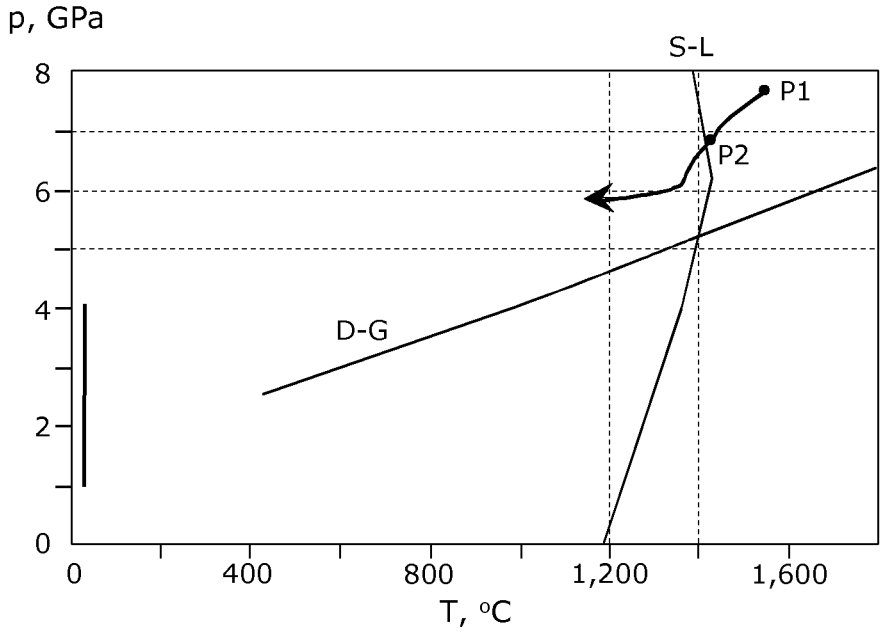

In a particular example method illustrated in FIG. 5, the first pressure P1 is about 7.8 gigapascals, the temperature at the first pressure being in the range of about 1,500 to about 1,600 degrees Celsius, and an example second pressure P2 is about 6.9 gigapascals.

Figure 6:
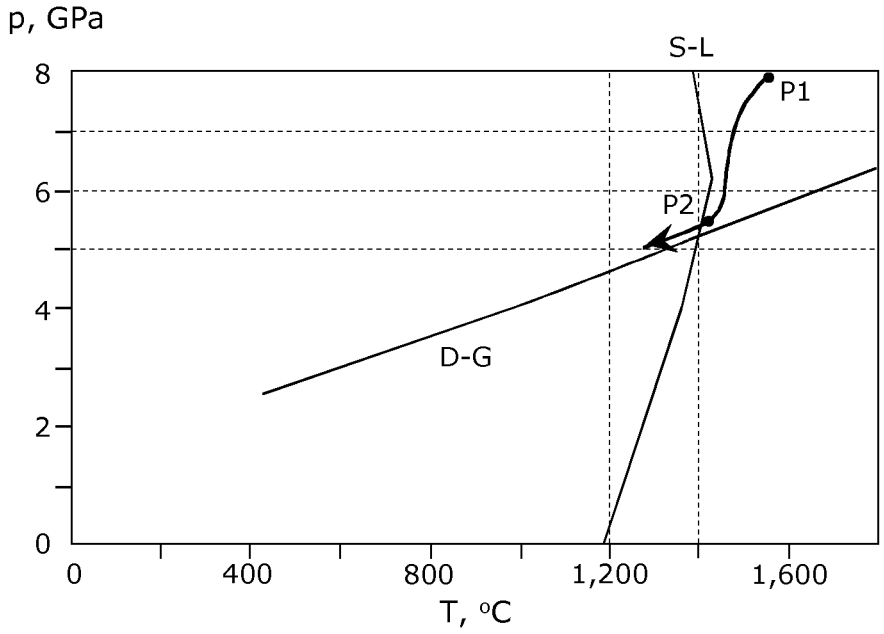

In a particular example method illustrated in FIG. 6, the first pressure P1 is about 7.9 gigapascals, the temperature at the first pressure being in the range of about 1,500 to about 1,600 degrees Celsius, and an example second pressure P2 is about 5.5 gigapascals.

Figure 7:
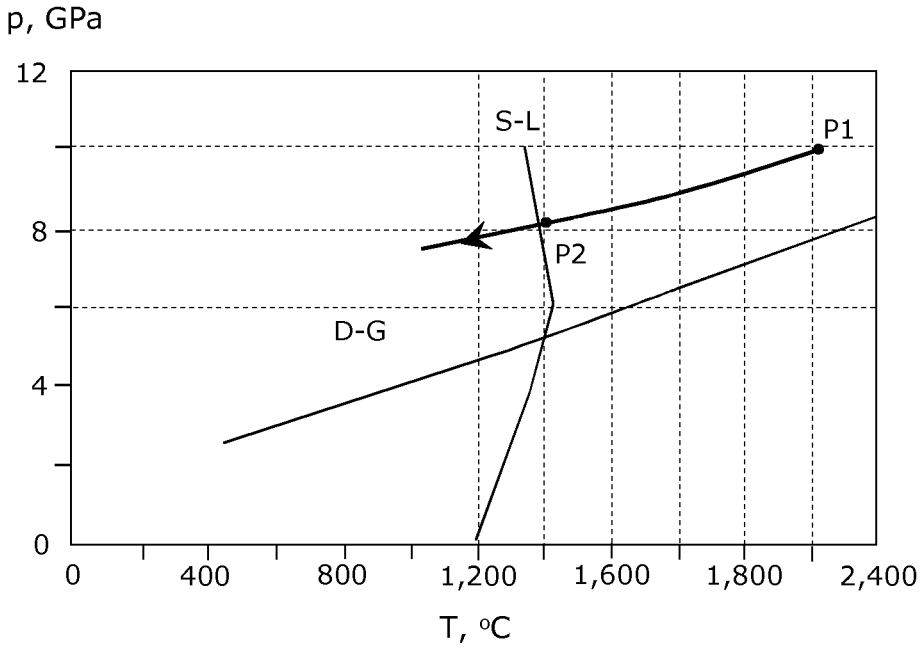

In the example method illustrated in FIG. 7, the first pressure P1 is about 9.9 gigapascals, the temperature at the first pressure being about 2,000 degrees Celsius, and an example second pressure P2 may be about 8.1 gigapascals.

Note that the line S-L in FIG. 3 to FIG. 7, indicating the melting and solidification temperatures of cobalt-based binder material in the presence of carbon, was estimated based on a calculation using available data. In practice, it may be advisable not to rely completely on calculated values lying on S-L but to carry out trial and error experiments to discover the melting and solidification temperatures for the particular binder material and pressure being used.

The method used to measure the pressure and temperature cycles as illustrated in FIG. 3 to FIG. 7 is measured using so-called K-type thermocouples and knowledge of the melting temperatures of copper (Cu) and silver (Ag). Data for the melting points of Cu and Ag measured using K-type thermocouples up at 60 kilobars was published by P. W. Mirwald and G. C. Kennedy in an article entitled "The melting curve of gold, silver and copper to 60-Kbar pressure—a reinvestigation", published on 10 Nov. 1979 in the Journal of Geophysical Research volume 84, number B12, pages 6750 to 6756, by The American Geophysical Union. A K-type thermocouple may also be referred to as a "chromel-alumel" thermocouple, in which the "chromel" component comprises 90 percent nickel and 10 percent chromium, and the "alumel" component comprises 95 percent nickel, 2 percent manganese, 2 percent aluminium and 1 percent silicon. The method includes inserting the junction of a first K-type thermocouple into a body consisting essentially of Cu and the junction of a second K-type thermocouple into a body consisting essentially of Ag, and positioning the two bodies proximate the pre-sinter assembly within the capsule. The readings from both thermocouples are recorded throughout at least a part of the pressure and temperature cycle and the readings processed and converted to pressure and temperature values according to the published data.

In some examples, the construction may comprise a polycrystalline cubic boron nitride (PCBN) structure joined to a cobalt cemented carbide substrate. In some example methods, an aggregation comprising cubic boron nitride (CBN) grains may be provided. The CBN grains may have a mean size of at least about 0.1 micron and at most about 30 microns. The aggregation may comprise tungsten carbide grains and or pre-cursor material for forming a matrix within which the CBN grains can dispersed in sintered PCBN material. In some examples, the aggregation may comprise a mixture of cubic boron nitride powder with a binder material containing Ti, Al, W or Co and the mixture cast into sheets using a plasticizer material. In some examples, the super-hard structure may comprise PCBN material substantially as described in international application number WO2007049140 and may be manufactured by a method including providing a powdered composition suitable for the manufacture of PCBN, the powder comprising at least 80 volume percent CBN particles and a powdered binder material, and subjecting the powder composition to attrition milling. The composition may comprise CBN particles of more than one average particle size. In various examples, the average size of the CBN particles may be at most about 12 microns or at most 2 microns. The binder material may include one or more of phase(s) containing aluminium, silicon, cobalt, molybdenum, tantalum, niobium, nickel, titanium, chromium, tungsten, yttrium, carbon and iron. The binder material may include powder with uniform solid solution of more than one of aluminium, silicon, cobalt, nickel, titanium, chromium, tungsten, yttrium, molybdenum, niobium, tantalum, carbon and iron.

Various kinds of ultra-high pressure presses may be used, including belt-type, tetrahedral multi-anvil, cubic multi-anvil, walker-type or torroidal presses. The choice of press type is likely to depend on the volume of the super-hard construction to be made and the pressure and temperature desired for sintering the super-hard material. For example, tetrahedral and cubic presses may be suitable for sintering commercially viable volumes of PCD and PCBN material at pressures of at least about 7 gigapascals or at least about 7.7 gigapascals.

Some example methods may include subjecting a PCD or PCBN construction to a heat treatment at a temperature of at least about 500 degrees Celsius, at least about 600 degrees Celsius or at least about 650 degrees Celsius for at least about 5 minutes, at least about 15 minutes or at least about 30 minutes. In some embodiments, the temperature may be at most about 850 degrees Celsius, at most about 800 degrees Celsius or at most about 750 degrees Celsius. In some embodiments, the PCD structure may be subjected to the heat treatment for at most about 120 minutes or at most about 60 minutes. In one embodiment, the PCD or PCBN structure may be subjected to the heat treatment in a vacuum. For example, U.S. Pat. No. 6,517,902 discloses a form of heat treatment for pre-form elements having a facing table of PCD bonded to a substrate of cemented tungsten carbide with a cobalt binder. The substrate includes an interface zone with at least 30 percent by volume of the cobalt binder in a hexagonal close packed crystal structure.

While wishing not to be bound by a particular theory, the method may result in a reduced likelihood or frequency of cracking of super-hard constructions because the residual stress within the construction is reduced.

Non-limiting examples are described in more detail below.

EXAMPLE 1

A PCD insert for a rock-boring drill bit was made as described below.

A pre-sinter assembly was prepared, comprising an aggregation of a plurality of diamond grains disposed against a proximate end of a generally cylindrical cemented carbide substrate. The aggregation comprised a plurality of wafers comprising diamond grains dispersed within an organic binder material, the diamond grains having a mean size of at least about 15 microns and at most about 30 microns. The substrate comprised about 90 weight percent WC grains cemented together by a binder material comprising Co. The pre-sinter assembly was enclosed in a metal jacket and heated to burn off the organic binder comprised in the wafers, and the jacketed, pre-sinter assembly was encapsulated in a capsule for an ultra-high pressure, high temperature multi-anvil press apparatus.

The pre-sinter assembly was subjected to a pressure of about 7.7 gigapascals and a temperature of about 1,550 degrees Celsius to sinter the diamond grains directly to each other to form a layer of PCD material connected to the proximate end of the substrate by a film of molten binder material comprising cobalt from the substrate. The pressure was reduced to about 5.5 gigapascals and the temperature was reduced to about 1,450 degrees Celsius, maintaining conditions at which the diamond comprised in the PCD is thermodynamically stable (in relation to graphite, a softer allotrope of carbon) and at which the binder material is in the liquid phase. The temperature was then reduced to about 1,000 degrees Celsius to solidify the binder material and form a construction comprising the layer of PCD bonded to the substrate by the solidified binder material, and the pressure and temperature were then reduced to ambient conditions.

The construction was subjected to a heat treatment at 660 degrees Celsius for about 2 hours at substantially ambient pressure in a substantially non-oxidising atmosphere, and then cooled to ambient temperature. No cracks were evident in the PCD layer after the heat treatment.

The construction was processed by grinding and polishing to provide an insert for a rock-boring drill bit.

For comparison, a reference construction was made as follows. A pre-sinter assembly was prepared as described above in relation to the example pre-sinter assembly. The pre-sinter assembly was subjected to a pressure of about 7.7 gigapascal and a temperature of about 1,550 degrees Celsius to sinter the diamond grains directly to each other to form a layer of PCD material connected to the proximate end of the substrate by a film of molten binder material comprising cobalt from the substrate. The temperature was reduced to about 1,000 degrees Celsius to solidify the binder material and form a construction comprising the layer of PCD bonded to the substrate by the solidified binder material, and then the pressure and temperature were reduced to ambient conditions. The construction was subjected to a heat treatment at 660 degrees Celsius for about 2 hours at substantially ambient pressure in a substantially non-oxidising atmosphere, and then cooled to ambient temperature. Severe cracks were evident at the side of the PCD layer after the heat treatment.

EXAMPLE 2

A PCD insert for a rock-boring drill bit was made as described below.

A pre-sinter assembly was prepared, comprising a PCD structure having a generally disc-like shape disposed against a proximate end of a generally cylindrical cemented carbide substrate. PCD structure had been made in a previous step involving sintering together an aggregation of a plurality of diamond grains at an ultra-high pressure of less than about 7 gigapascals and a high temperature (at which the diamond was thermodynamically more stable than graphite). The substrate comprised about 90 weight percent WC grains cemented together by a binder material comprising Co. The pre-sinter assembly was enclosed in a metal jacket and heated to burn off the organic binder comprised in the wafers, and the jacketed, pre-sinter assembly was encapsulated in a capsule for an ultra-high pressure, high temperature multi-anvil press apparatus.

The pre-sinter assembly was subjected to a pressure of about 7.7 gigapascals and a temperature of about 1,550 degrees Celsius to modify the microstructure of the PCD structure. The pressure was reduced to about 5.5 gigapascals and the temperature was reduced to about 1,450 degrees Celsius, maintaining conditions at which the diamond comprised in the PCD is thermodynamically stable (in relation to graphite, a softer allotrope of carbon) and at which the binder material is in the liquid phase. The temperature was then reduced to about 1,000 degrees Celsius to solidify the binder material and form a construction comprising the layer of PCD bonded to the substrate by the solidified binder material, and the pressure and temperature were then reduced to ambient conditions.

The construction was subjected to a heat treatment at 660 degrees Celsius for about 2 hours at substantially ambient pressure in a substantially non-oxidising atmosphere, and then cooled to ambient temperature. No cracks were evident in the PCD layer after the heat treatment.

The construction was processed by grinding and polishing to provide an insert for a rock-boring drill bit.

Certain terms and concepts as used herein will be briefly explained

As used herein, "super-hard" means a Vickers hardness of at least 25 gigapascal. Synthetic and natural diamond, polycrystalline diamond (PCD), cubic boron nitride (cBN) and polycrystalline cBN (PCBN) material are examples of super-hard materials. Synthetic diamond, which is also called man-made diamond, is diamond material that has been manufactured.

As used herein, PCBN material comprises grains of cubic boron nitride (cBN) dispersed within a matrix comprising metal and or ceramic material.

PCD material comprises a mass (an aggregation of a plurality) of diamond grains, a substantial portion of which are directly inter-bonded with each other and in which the content of diamond is at least about 80 volume percent of the material. Interstices between the diamond grains may be at least partly filled with a binder material comprising a catalyst material for synthetic diamond, or they may be substantially empty. Catalyst material (which may also be referred to as solvent/catalyst material, reflecting the understanding that the material may perform a catalytic and or solvent function in promoting the growth of diamond grains and the sintering of diamond grains) for synthetic diamond is capable of promoting the growth of synthetic diamond grains and or the direct intergrowth of synthetic or natural diamond grains at a temperature and pressure at which synthetic or natural diamond is thermodynamically more stable than graphite. Examples of catalyst materials for diamond are Fe, Ni, Co and Mn, and certain alloys including these. Bodies comprising PCD material may comprise at least a region from which catalyst material has been removed from the interstices, leaving interstitial voids between the diamond grains. Various grades of PCD material may be made. As used herein, a PCD grade is a variant of PCD material characterised in terms of the volume content and size of diamond grains, the volume content of interstitial regions between the diamond grains and composition of material that may be present within the interstitial regions. Different PCD grades may have different microstructure and different mechanical properties, such as elastic (or Young's) modulus E, modulus of elasticity, transverse rupture strength (TRS), toughness (such as so-called $K_1C$ toughness), hardness, density and coefficient of thermal expansion (CTE). Different PCD grades may also perform differently in use. For example, the wear rate and fracture resistance of different PCD grades may be different.

Thermally stable PCD material comprises at least a part or volume of which exhibits no substantial structural degradation or deterioration of hardness or abrasion resistance after exposure to a temperature above about 400 degrees Celsius, or even above about 700 degrees Celsius. For example, PCD material containing less than about 2 weight percent of catalyst metal for diamond such as Co, Fe, Ni, Mn in catalytically active form (e.g. in elemental form) may be thermally stable. PCD material that is substantially free of catalyst material in catalytically active form is an example of thermally stable PCD. PCD material in which the interstices are substantially voids or at least partly filled with ceramic material such as SiC or salt material such as carbonate compounds may be thermally stable, for example. PCD structures having at least a significant region from which catalyst material for diamond has been depleted, or in which catalyst material is in a form that is relatively less active as a catalyst, may be described as thermally stable PCD.

Other examples of superhard materials include certain composite materials comprising diamond or cBN grains held together by a matrix comprising ceramic material, such as silicon carbide (SiC), or cemented carbide material, such as Co-bonded WC material (for example, as described in U.S. Pat. Nos. 5,453,105 or 6,919,040). For example, certain SiC-bonded diamond materials may comprise at least about 30 volume percent diamond grains dispersed in a SiC matrix (which may contain a minor amount of Si in a form other than SiC). Examples of SiC-bonded diamond materials are described in U.S. Pat. Nos. 7,008,672; 6,709,747; 6,179,886; 6,447,852; and International Application publication number WO2009/013713).

Young's modulus is a type of elastic modulus and is a measure of the uni-axial strain in response to a uni-axial stress, within the range of stress for which the material behaves elastically. A method of measuring the Young's modulus E is by means of measuring the transverse and longitudinal components of the speed of sound through the material using ultrasonic waves.

The invention claimed is:

1. A method for making a super-hard construction comprising: a first structure joined to a second structure, the first structure comprising first material having a first coefficient of thermal expansion (CTE) and a first Young's modulus, and the second structure comprising second material having a second CTE and a second Young's modulus; the first CTE and the second CTE being different from each other and the first Young's modulus and the second Young's modulus being different from each other; at least one of the first or second materials comprising super-hard material; the method including:

forming an assembly comprising the first material, the second material and a binder material arranged to be capable of bonding the first and second materials together, the binder material comprising metal; subjecting the assembly to a sufficiently high temperature for the binder material to be in the liquid state and to a first pressure at which the super-hard material is thermodynamically stable; reducing the pressure from the first pressure to an intermediate pressure for a holding period, and then further reducing the pressure from the intermediate pressure to a second pressure at which the super-hard material is thermodynamically stable, the temperature being maintained sufficiently high to maintain the binder material in the liquid state; reducing the temperature to solidify the binder material; and reducing the pressure and the temperature to an ambient condition to provide the super-hard construction.

2. A method as claimed in claim 1, in which the CTE of one of the first or second materials is at least $2.5\times10^{-6}$ per degree Celsius and at most $5.0\times10^{-6}$ per degree Celsius and the CTE of the other of the first or second materials is at least $3.5\times10^{-6}$ per degree Celsius and at most $6.5\times10^{-6}$ per degree Celsius, at about 25 degrees Celsius.

3. A method as claimed in claim 1, in which the Young's modulus of one of the first or second materials is at least 500 gigapascals and at most 1,300 gigapascals and the Young's modulus of the other of the first and second materials is at least 800 gigapascals and at most 1,600 gigapascals.

4. A method as claimed in claim 1, in which the Young's moduli of the first and second materials differ by at least 10%.

5. A method as claimed in claim 1, in which the CTE of the first and second materials differ by at least 10%.

6. A method as claimed in claim 1, including sintering an aggregation of a plurality of grains of the super-hard material in the presence of sinter catalyst material at a sinter pressure and a sinter temperature to form the second structure.

7. A method as claimed in claim 1, including disposing an aggregation of grains of super-hard material adjacent the first structure and in the presence of the binder material to form a pre-sinter assembly; subjecting the pre-sinter assembly to a sinter pressure and a sinter temperature to melt the binder material and sinter the grains of super-hard materials and form the second structure comprising polycrystalline super-hard material connected to the first structure by the binder material in the molten state.

8. A method as claimed in claim 6, in which the first pressure is substantially the sinter pressure.

9. A method as claimed in claim 1, including providing the first structure, providing the second structure comprising polycrystalline super-hard material, disposing the first structure adjacent the second structure and forming a pre-construction assembly, and applying a pressure to the pre-construction assembly, increasing the pressure from ambient pressure to the first pressure.

10. A method as claimed in claim 9, including subjecting an aggregation of a plurality of grains of super-hard material to a sinter pressure and a sinter temperature at which the super-hard material is capable of being sintered to form the second material, and reducing the pressure and temperature to an ambient condition to provide the second structure; the first pressure being greater than the sinter pressure.

11. A method as claimed in claim 1, in which the second structure comprises diamond material and the binder material comprises catalyst material for diamond.

12. A method as claimed in claim 1, in which the first and second structures each comprise diamond material and the binder material comprises catalyst material for diamond.

13. A method as claimed in claim 1, in which the difference between the second pressure and the first pressure is at least 0.5 gigapascal.

14. A method as claimed in claim 1, including subjecting the super-hard construction to further heat treatment at a treatment temperature and a treatment pressure at which the super-hard material is thermodynamically meta-stable.

15. A method as claimed in claim 14, in which the super-hard material comprises diamond material and the treatment temperature is at least 500 degrees Celsius and the treatment pressure is less than 1 gigapascal.

16. A method as claimed in claim 1, wherein the pressure is reduced from the first pressure to the second pressure at a first rate, and wherein the pressure is reduced from the second pressure to the ambient condition at a second rate, the second rate being different than the first rate.

17. A method as claimed in claim 1, in which the first pressure is at least 7 gigapascals, the intermediate pressure is at least 5.5 gigapascals and less than 10 gigapascals, the holding period is at least 1 minute and the second pressure is at least 5.5 gigapascals and at most 7 gigapascals.

18. A method as claimed in claim 1, including processing the super-hard construction to provide a tool element.

19. A method as claimed in claim 1, in which the super-hard construction is configured for a tool element for a rock-boring drill bit.

20. A method as claimed in claim 1, in which the super-hard construction is configured for an impact tool for degrading rock or pavement.

21. A method as claimed in claim 1, in which the pressure at which the binder material begins to solidify responsive to the reduction in temperature is substantially equal to the second pressure.

22. A method as claimed in claim 1, in which the pressure at which the binder material begins to solidify responsive to the reduction in temperature is less than the second pressure.

23. A method as claimed in claim 1, in which the first structure comprises cobalt-cemented tungsten carbide material and the second material comprises PCD material, the CTE of the cemented carbide material being in the range of $4.5\times10^{-6}$ to $6.5\times10^{-6}$ per degree Celsius, the CTE of the PCD material being in the range of $3.0\times10^{-6}$ to $5.0\times10^{-6}$ per degree Celsius; the Young's modulus of the cemented carbide material being in the range of 500 to 1,000 gigapascals, and the Young's modulus of the PCD material being in the range of 800 to 1,600 gigapascals; the first pressure being in the range of 6 to 10 gigapascals, and the second pressure being in the range of 5.5 to 8 gigapascals.

24. A method as claimed in claim 1, in which the pressure at which the cobalt-based binder material comprised in the cemented carbide material begins to solidify is equal to the second pressure.

25. A method as claimed in claim 1, in which the second pressure is in the range of 6.5 to 7.5 gigapascals.

26. A method as claimed in claim 1, in which the second structure comprises PCD material and the method includes subjecting the super-hard construction to further heat treatment for a treatment period in the range of 30 to 90 minutes at a treatment temperature in the range of 550 to 650 degrees Celsius.

* * * * *